US005189431A

United States Patent [19]

Marinelli

[11] Patent Number: 5,189,431

[45] Date of Patent: Feb. 23, 1993

[54] REMOVABLE ANTENNA COUPLING ON A WRIST WATCH PAGER

[75] Inventor: Robert A. Marinelli, Boynton Beach, Fla.

[73] Assignee: Motorola, Inc., Schaumburg, Ill.

[21] Appl. No.: 863,528

[22] Filed: Apr. 6, 1992

Related U.S. Application Data

[63] Continuation of Ser. No. 600,874, Oct. 22, 1990, abandoned.

[51] Int. Cl.[5] ..... H01Q 1/44; H01Q 1/27; H01R 31/00

[52] U.S. Cl. ..... 343/718; 439/31

[58] Field of Search ..... 343/718, 850, 870, 741; 368/10, 281, 282; 224/167, 168, 175, 180; 439/18, 23, 24, 28, 31, 37

[56] References Cited

U.S. PATENT DOCUMENTS

| | | | |
|---|---|---|---|
| 3,032,651 | 5/1962 | Stahli et al. | 343/718 |
| 4,713,808 | 12/1987 | Gaskill et al. | 370/94 |
| 4,817,196 | 3/1989 | Macnak et al. | 343/718 |
| 4,922,260 | 5/1990 | Gaskill et al. | 343/718 |
| 4,947,179 | 8/1990 | Ganter et al. | 343/718 |
| 4,977,614 | 12/1990 | Kurcbart | 343/718 |
| 5,072,231 | 12/1991 | Koyama | 343/718 |

*Primary Examiner*—Rolf Hille
*Assistant Examiner*—Peter Toby Brown
*Attorney, Agent, or Firm*—Philip P. Macnak; William E. Koch; Thomas G. Berry

[57] ABSTRACT

A selective call receiver (100) includes a receiver for receiving a message and a housing (104) for enclosing a receiver (102). A substantially semicircular arcuate recess (106) shaped in a portion of the housing receives a first substantially semicircular arcuate contact (108) that has a substantially arcuate outer surface which provides a non-movable mechanical coupling with the substantially semicircular arcuate recess (106). The first substantially semicircular arcuate contact (108) has a substantially arcuate inner surface, and a second substantially arcuate contact (114) terminates an end of a wrist band antenna (112') which has an outer contact surface for coupling with the substantially arcuate inner surface of the first substantially semicircular arcuate contact (108) thereby forming a movable electrical coupling therebetween.

5 Claims, 1 Drawing Sheet

REMOVABLE ANTENNA COUPLING ON A WRIST WATCH PAGER

This is a continuation of application Ser. No. 07/600,874 filed Oct. 22, 1990, now abandoned.

FIELD OF THE INVENTION

This invention relates in general to antennas, and more specifically to an antenna disposed within a securing means that is removably coupled to a selective call receiver.

BACKGROUND OF THE INVENTION

Throughout the years, selective call receivers have reduced significantly in size. This reduction was made possible by numerous advances in integrated circuit (IC) technology, which is partly responsible for contemporary miniature receivers. However, this miniaturization in electrical receivers has placed a severe demand on the mechanical components of receivers. That is, the materials and the methods of coupling the mechanical parts together must be more stress resistant.

For example, consider the increased stress placed upon an antenna of a wrist watch selective call receiver (e.g., pager) that is substantially disposed within a watch band. During normal operation, the watch band must be flexible and movable while contemporaneously maintaining the electrical contact between the antenna and the receiver. Previous methods of coupling antennas to receivers generally require the antenna to be rigidly fixed to a housing via a coupling pin. The coupling pin could typically move at two fixed points. This movement, however, causes excessive wear and corrosion at the two fixed points. The excessive wear and/or the corrosion can eventually result in an open-circuit between the receiver and the antenna.

Additionally, current methods of coupling the watch band antenna a wrist worn receiver requires too many component parts to effectuate an effective electrical coupling therebetween. Generally, this coupling is substantially cumbersome for users and repair personnel that must remove and replace the antenna/watch band assembly.

Thus, what is needed is a method of coupling an antenna within a watch band to a receiver that reduces wear between the coupling parts, while maintaining electrical contact that is secure and easy to remove and replace.

SUMMARY OF THE INVENTION

A selective call receiver comprises means for receiving a message and a housing for enclosing the receiving means. A substantially semicircular arcuate recess shaped in a portion of the housing receives a first substantially semicircular arcuate contact that has a substantially arcuate outer surface which provides a nonmovable mechanical coupling with the substantially semicircular arcuate recess. The first substantially semicircular arcuate contact has a substantially arcuate inner surface, and a second substantially arcuate contact terminates an end of a wrist band antenna which has an outer contact surface for coupling with the substantially arcuate inner surface of the first substantially semicircular arcuate contact thereby forming a movable electrical coupling therebetween.

DESCRIPTION OF A PREFERRED EMBODIMENT

Figure 1:
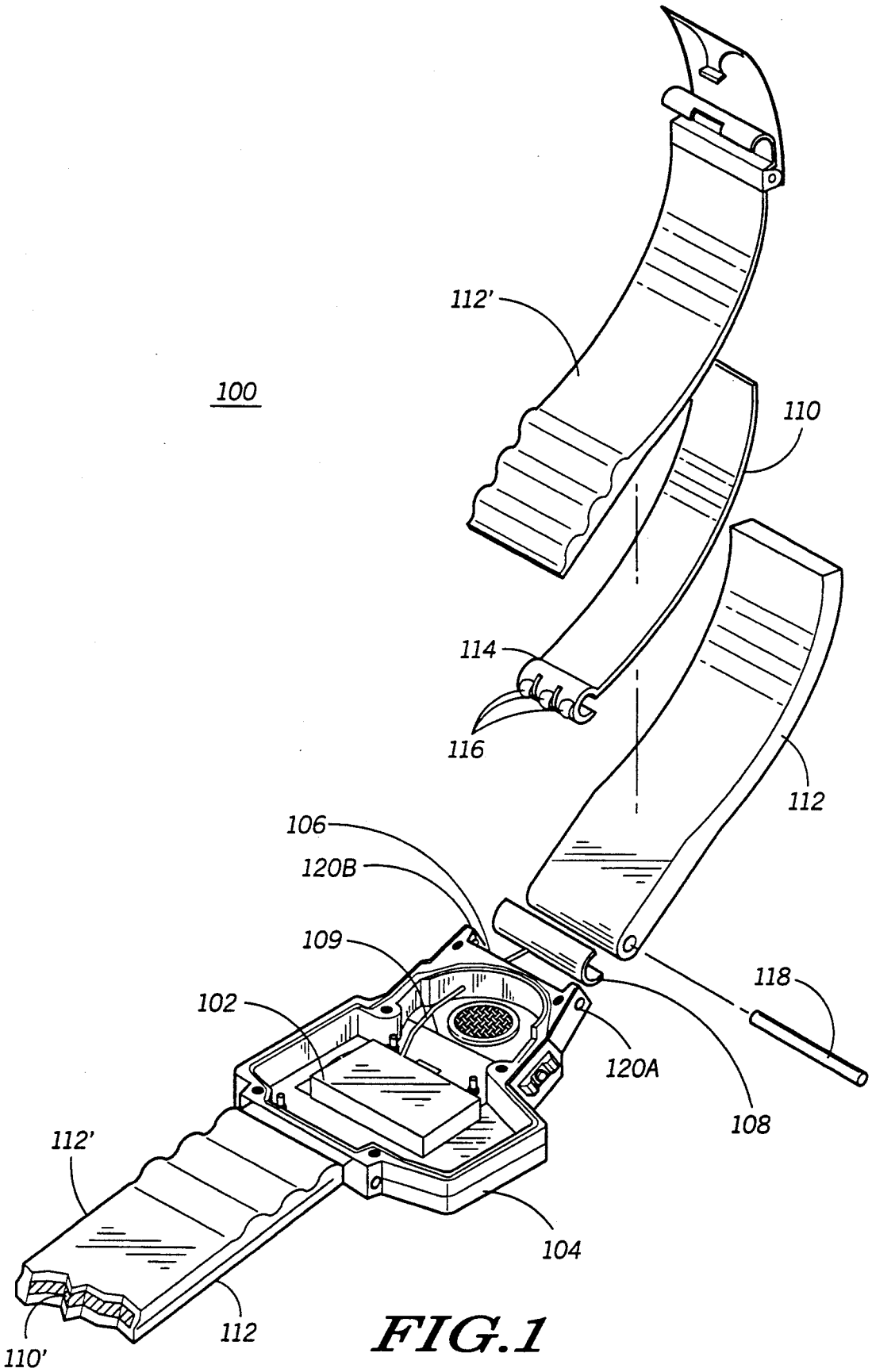
FIG. 1 is an illustration of a selective call receiver in accordance with the present invention.

Referring to FIG. 1, a selective call receiver 100 (e.g., a wrist watch pager) is shown in accordance with the present invention. The operation of the selective call receiver 100 is well known to those skilled in the art. According to the invention, the selective call receiver 100 comprises a receiver module 102 of conventional design enclosed within a housing enclosure 104. The housing enclosure 104 includes a substantially arcuate shaped recess 106 preferably adapted to receive a first substantially arcuate contact 108 electrically coupled 109 to the receiver module 102. During assembly, the first substantially arcuate contact 108 is placed within the substantially arcuate recess 106. An antenna portion 110 has a second mating or corresponding substantially arcuate contact 114 at one end for coupling to the first substantially arcuate contact 108. The second substantially arcuate contact 114 preferably has at least one protrusion 116 that facilitates electrical contact to complete an electrical coupling to the first substantially arcuate contact 108. In this way, the antenna (when coupled to the housing enclosure 104) is free to rotate while still maintaining electrical coupling between the antenna, 110 and the receiver module 102. The at least one protrusion 116 provides a wiping action as the coupling contact 114 rotates within the fixed coupling contact 108, thus preventing the formation of contaminating films between the contacts 108, 114. This wiping action further removes dirt/dust and oil from accumulating between the contacts 108, 114.

During assembly, the antenna portion 110 is preferably disposed between two sections of a securing (e.g., watch/selective call receiver) band 112 and 112'. The securing band, after assembly, including the antenna 110 with the second substantially arcuate contact 114 can be readily fitted into the first substantially arcuate contact 108. Applying a minimum force in securing the band 112, the coupling pin 118 may be inserted into an aperture 120A and through the securing band until the coupling pin 118 fits securely within a second aperture 120B.

An alternate arrangement for attaching the securing band to the housing enclosure 104 includes using a typical compressible watch spring pin (not shown) which is known to those skilled in the art. To use the compressible spring watch pin, the pin is first inserted within the securing band and while the pin is compressed the securing band fitted within the housing enclosure recess 106. The compression is removed when the pin is in place within the housing enclosure recess 106, which causes both ends of the pin to expand into both apertures 120 A,B resulting in a mechanical coupling between the securing band 112 and the housing enclosure 104.

The force from the mechanical coupling ensures electrical contact between the first and second substantially arcuate contacts 108, 114 resulting in a removable electrical coupling. In this way, the securing band/antenna is easily removed and replaced. This method of coupling results in fewer number of parts between the antenna 110 and the receiver module 102, thus resulting in a more economical and reliable electrical coupling.

In summary, a selective call receiver that includes a housing enclosure with a substantially arcuate electrical coupling that is removably coupled to an antenna disposed within a securing device that secures the selective call receiver to a object. In this way, the assembly is free to rotate while still maintaining an electrical coupling between the antenna and the receiver module. Operationally, at least one protrusion provides a wiping action as the coupling rotates, thus preventing the formation of contaminating film between the contacts. This wiping action further removes any dirt/dust and oil from accumulating between the contacts.

I claim:

1. A selective call receiver, comprising:

means for receiving a message;

a housing for enclosing the receiving means, a substantially semicircular arcuate recess shaped in a portion of said housing for receiving a first substantially semicircular arcuate contact having a substantially arcuate outer surface for providing a non-movable mechanical coupling with the substantially semicircular arcuate recess, said first substantially semicircular arcuate contact having a substantially arcuate inner surface; and a second substantially arcuate contact terminating an end of a wrist band antenna, said second substantially arcuate contact having an outer contact surface for coupling with said substantially arcuate inner surface of the first substantially semicircular arcuate contact thereby forming a movable electrical coupling therebetween.

2. The selective call receiver according to claim 1 wherein the wrist band antenna is disposed within a securing means comprising a flexible watch band assembly.

3. The selective call receiver according to claim 1 wherein the housing comprises a wrist watch enclosure.

4. The selective call receiver according to claim 1 wherein the outer surface of the second substantially arcuate contact comprises at least one protrusion for electrically coupling with the substantially arcuate inner surface of the first substantially arcuate contact.

5. The selective call receiver according to claim 4 wherein the at least one protrusion on the outer surface of the second substantially arcuate contact couples with the substantially arcuate inner surface of the first substantially semicircular arcuate contact for providing a wiping electrical coupling therebetween.

* * * * *